US005472197A

United States Patent [19]

Gwiasda et al.

[11] Patent Number: 5,472,197

[45] Date of Patent: Dec. 5, 1995

[54] SLOT MACHINE ARM SWITCH CONTROLLER

[75] Inventors: Bill Gwiasda, Hanover Park; Eric Hujar, Park Ridge, both of Ill.

[73] Assignee: WMS Gaming Inc., Chicago, Ill.

[21] Appl. No.: 276,528

[22] Filed: Jul. 18, 1994

[51] Int. Cl.[6] ..... A63F 5/04

[52] U.S. Cl. ..... 273/143 R

[58] Field of Search ..... 273/143 R

[56] References Cited

U.S. PATENT DOCUMENTS 4,618,150 10/1986 Kimura ..... 273/143 R 4,773,647 9/1988 Okada et al. ..... 273/143 R 5,154,421 10/1992 Hamano ..... 273/143 R 5,169,147 12/1992 Hamano ..... 273/138 A

*Primary Examiner*—William H. Grieb

*Attorney, Agent, or Firm*—Rockey, Rifkin and Ryther

[57] ABSTRACT

In a reel-type slot machine, indicia (reel spin time, reel spin speed, sound, lights, etc.) are varied based on the manner in which the handle is operated. Microswitches are provided to start and stop a timer circuit such that the time required for the handle's rotation can be measured. The game microprocessor looks up the set of values in a ROM table which correspond to the measured timing interval and then implements those values.

5 Claims, 2 Drawing Sheets

| A | B | C | D |
|---|---|---|---|
| TIME BETWEEN SWITCH ACTIVATIONS (SECONDS) | TIME BEFORE FIRST REEL BEGINS TO STOP (SECONDS) | REEL SPIN SPEED (REVOLUTIONS/SEC) | REEL STOP EFFECT (TIME REQUIRED FOR REELS TO STOP) |
| 0.00-0.17 | 4.0 | 2.5 | 1.2 SEC |
| 0.171-0.45 | 2.5 | 2.5 | 150 MSEC |
| 0.451-0.70 | 2.0 | 2.5 | 150 MSEC |
| 0.701-2.00 | 1.2 | 0.833 | 150 MSEC |
| 2.001 | 0.05 | 0.5 | 150 MSEC |

SLOT MACHINE ARM SWITCH CONTROLLER

BACKGROUND AND SUMMARY OF THE INVENTION

The present invention generally relates to gaming devices and, more particularly, to reel-type slot machines. A typical reel-type slot machine includes a plurality of reels each having a system of symbols displayed thereon. The person who plays the game pulls a handle on the side of the slot machine to initiate rotation of the reels via a microprocessor controlled motor and step drive. The reels are stopped to display a randomly selected set of symbols on the pay line(s) of the slot machine. If a winning combination of symbols is obtained, a payout is made.

Manufacturers of reel-type slot machines continually search for new ways to improve their products to maintain player interest. The present invention relates to a device for simulating player control of the spinning of the reels. In reality, the microprocessor, in accordance with the game program, determines how long and fast the reels spin, and what combination of symbols will appear on the pay line. However, by varying the speed and length of reel spin as a function of player input, without otherwise affecting the outcome, the player is given a feeling of control over the otherwise random, statistical event of selecting the symbols to display on the pay line and the payouts corresponding thereto.

The slot machine arm controller of the invention is a feature which can be easily incorporated in a reel-type slot machine. Generally, the microprocessor initializes various slot machine game indicia based on the time it takes for the player to rotate the slot machine's handle through a predetermined arc. A non-inclusive list of such indicia are lights can be lit, dimmed or flashed, a sound system can play music at various tempos and the slot reels can spin at different speeds and/or for different lengths of time.

To start play of the machine, the player rotates the handle from an initial at-rest position to a stop position, the handle being spring-biased to return to the initial position. A first microswitch signals the game microprocessor to start a timer circuit when the handle is rotated from the initial position. A second microswitch signals the microprocessor to stop the timer circuit after the handle rotates through the predetermined arc. Based upon an evaluation of the measured time, various slot machine game indicia can be set by the game microprocessor to commence play of the game.

DESCRIPTION OF A PREFERRED EMBODIMENT

Figure 1:
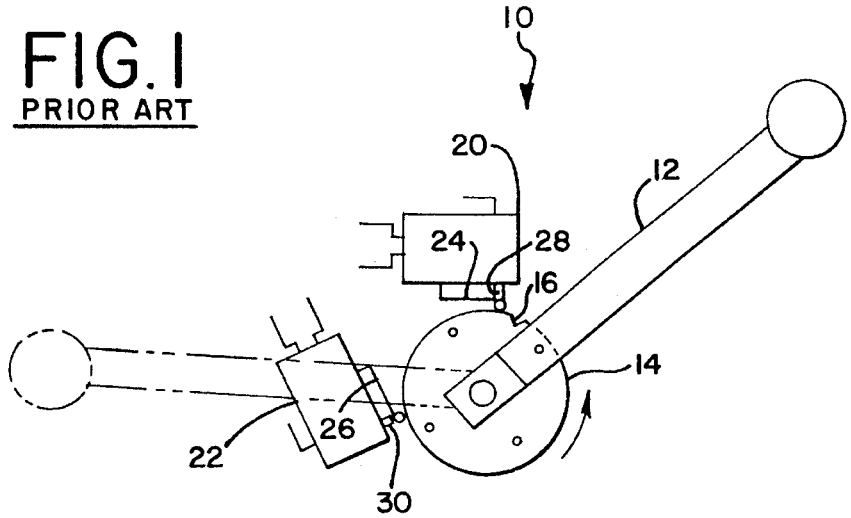
FIG. 1 PRIOR ART
FIG. 1 is a side view of a typical slot arm mechanism.

Referring to FIG. 1, a side view of a typical slot machine arm mechanism 10 is illustrated. Arm mechanism 10 includes a rotating handle 12 and a cam member 14 both of which are attached to the side of a reel-type slot machine (not shown). A player pulls handle 12 to initiate rotation of the slot reels.

Handle 12 and cam 14 are rotated from an initial at-rest position shown in solid to a fully extended position shown in phantom in FIG. 1. First and second microswitches 20 and 22 each include leaf arms 24 and 26 which are biased against terminals 28 and 30 respectively by engagement with cam 14. Once handle 12 has been rotated from its initial position, a latch (not shown) precludes the handle from returning to its initial position until it reaches its fully extended position.

Cam 14 includes a notch 16 which is positioned to open switch 20 by allowing arm 24 to break contact with terminal 28 after the handle rotates from its initial position. Microswitch 22 is positioned relative to cam 14 to be opened by notch 16 after the handle rotates through the predetermined arc. The handle's rotational velocity can be determined by measuring the time between the activation of the switches 20 and 22 because the distance therebetween is known.

Figure 2:
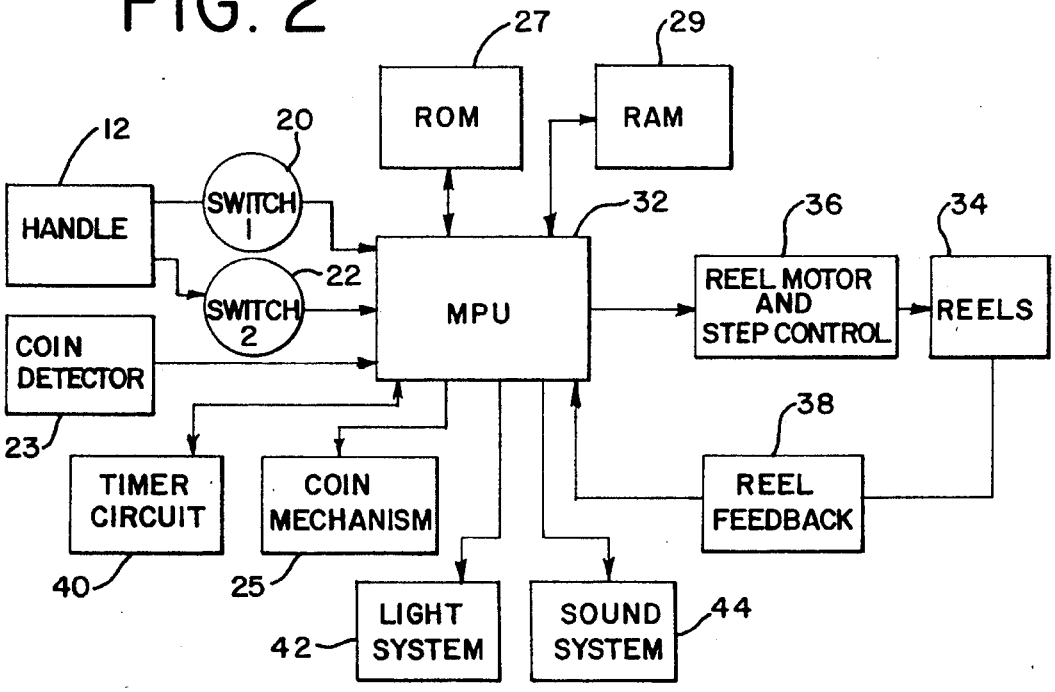
FIG. 2 is a block diagram of a reel-type slot machine control system in which the present invention can be practiced.

FIG. 2 is a block diagram of a control system for practicing the present invention. Coin detector 23 sends a signal to microprocessor 32 when a coin is inserted into the machine. If a player wins, then a payoff is made via a conventional coin mechanism 25.

Reel motor and step controller 36 rotates the reels 34 in response to a signal from microprocessor 32. The signal is generated after both of the microswitches 20 and 22 have been activated when handle 12 is pulled. Reel feedback is provided by feedback block 38 (usually implemented with a shaft encoder) to allow controller 36 to precisely stop the reels at positions determined by microprocessor 32.

Microprocessor 32 controls light system 42 and sound system 44 to attract players to the slot machine as discussed with reference to FIGS. 3 and 4. Typically, light system 42 comprises a plurality of lights arranged on the slot machine which can be made to blink or dim. Sound system 44 can play and broadcast predetermined music or messages at varying tempos.

Timer circuit 40 is controlled by microprocessor 32 via switches 20 and 22 thereby to precisely measure the time interval required for the handle 12 to be rotated through the arc defined by switches 20 and 22. Microprocessor 32 utilizes the measured time interval to implement various sets of slot machine game indicia as discussed hereafter.

Figures 3, 4:
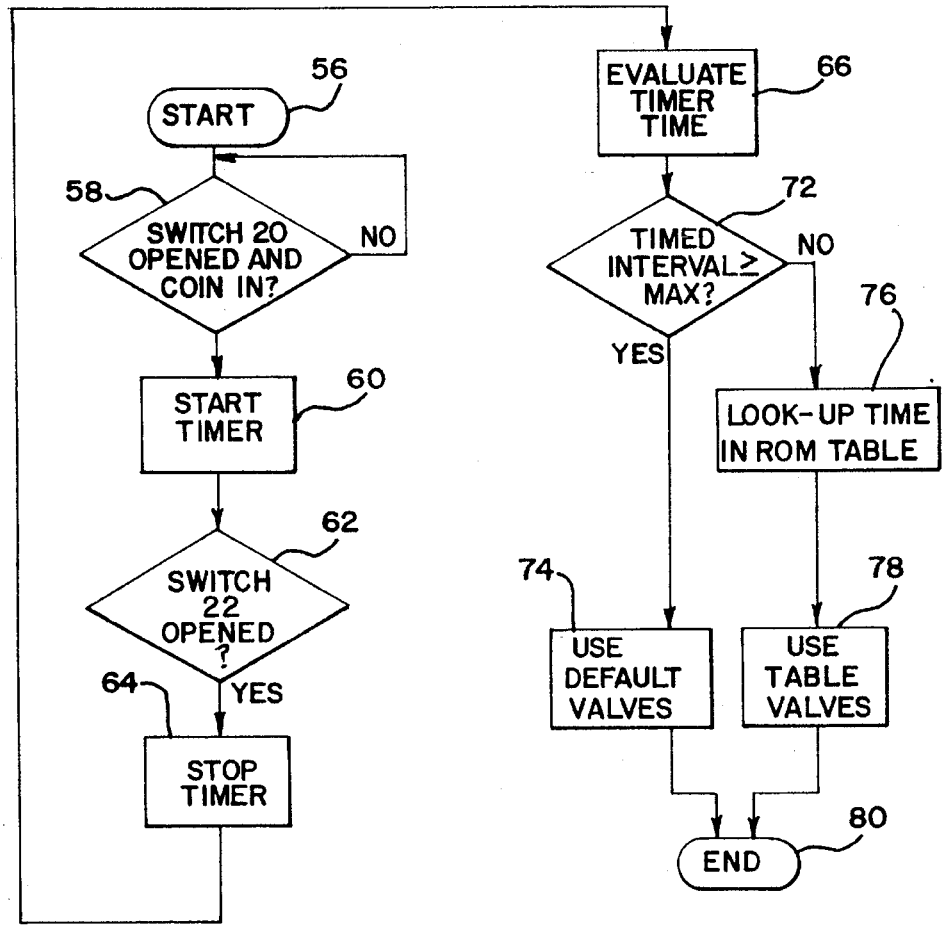
FIG. 3 is a computer flow diagram helpful in understanding the present invention.
FIG. 4 is a simplified diagram of a look-up table illustrating one type of operation that can be implemented.

FIG. 3 is a flow diagram which illustrates the steps necessary to practice a preferred embodiment of the invention. The listed steps are stored as a computer program in a read only memory 27 associated with microprocessor 32. Microprocessor 32 executes the instructions stored in ROM 27 and uses RAM 29 to store current game data. Because FIG. 3 is a flow diagram, the programming of the present invention can be accomplished on any computer system desired.

The program begins at start step 56. The time required for handle 12 to rotate between the arc defined by switches 20 and 22 is measured and evaluated in steps 56–70. After a player inserts the requisite coins and rotates the handle 12, it is determined whether switch 20 has been opened. If switch 20 has been opened, then microprocessor 32 initiates timer circuit 40. When switch 22 is opened, microprocessor 32 stops timer circuit 40 and evaluates the timed interval to determine how to implement the various game indicia.

If the measured time is greater than a predetermined maximum amount, then default values are used to control operation of the slot machine, steps 72 and 74. However, differing sets of slot machine game indicia can be implemented by microprocessor 32 if the measured time interval is less than the permitted maximum. Thus, the alteration of the game indicia is directly related to the rotational speed of handle 12. The possible values for the rotational speed of handle 12 are divided into a set of ranges. A set of predetermined slot machine game indicia values are assigned to each of the ranges which are stored as a table in ROM 27 (see FIG. 4).

If the measured time interval is less than the maximum time allowed for handle 12 to be rotated, then microprocessor 32 looks up the appropriate set of indicia values in the ROM table based on that measured time interval, steps 72 and 76. Then, the specified indicia values are implemented in step 78 with the program ending in step 80.

The slot arm mechanism of the invention is provided to foster general player interest in slot machines and, in particular, to attract players to slot machines such that game revenue is maximized. For example, various reel spin characteristics can be changed based on the measured time interval such as an increase or decrease in the reels' rotational velocity and the length of spinning time. The amount of time required for the reels to stop spinning, the reel stop effect, can be varied based upon the handle's rotational speed. Also, light and sound effects from light system 42 and sound system 44 can be implemented to attract players.

FIG. 4 is a simplified diagram of a look-up table stored in ROM 27 illustrating one type of indicia that can be implemented by microprocessor 32. For exemplary purposes, FIG. 4 lists various times for the handle to rotate through the predetermined arc in column A with the corresponding indicia values listed in columns B–D (the time before the first reel begins to stop, the reel spin speed and the reel stop effect). The reel stop effect, either slow or quick, describes the amount of time required for the reels to stop spinning.

For example, if it takes 0.50 seconds for the handle to be rotated, then there will be a 2.0 second delay before the first reel begins to stop, the reels will spin at 2.5 revolutions/sec and all of the reels will be quickly stopped. When a reel is quickly stopped, the reel will stop spinning in no longer than 150 msec. If it takes 0.1 seconds for the handle to be rotated, then there will be a 4.0 second delay before the first reel begins to stop, the reels will spin at 2.5 revolutions per second and each reel will stop in no more than 1.2 seconds.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A reel-type slot machine comprising:

a) a plurality of slot reels rotatable about a common axis through a fixed number of stop positions, each reel having viewable symbols located thereon;

b) a handle for initiating the spinning of the reels;

c) means for measuring the time interval for the handle to rotate through a predetermined arc; and d) means for spinning and stopping the reels to display a set of symbols to the player including means for changing the spin time, spin speed and stop time as a function of the measured time interval.

2. The reel-type slot machine of claim 1 wherein said means for measuring includes a pair of microswitches which are activated by said handle as it is operated by the player.

3. The reel-type slot machine of claim 2 wherein said means for measuring further includes a timer circuit for measuring a time interval between the activations of said microswitches.

4. The reel-type slot machine of claim 1 further comprising a plurality of lights which flash as a function of the measured time interval.

5. The reel-type slot machine of claim 1 further comprising a sound system for playing music at a tempo related to the measured time interval.

* * * * *